United States Patent [19]

Durant et al.

[11] Patent Number: 5,038,900

[45] Date of Patent: Aug. 13, 1991

[54] SUSPENSION CONVEYOR SYSTEM

[75] Inventors: Siegfried Durant, Landsberg/Lech; Klaus Sporer, Hohenfurch; Josef Hafner, Landsberg/Lech, all of Fed. Rep. of Germany

[73] Assignee: Veit Transpo GmbH, Landsberg/Lech., Fed. Rep. of Germany

[21] Appl. No.: 457,476

[22] Filed: Jan. 2, 1990

[30] Foreign Application Priority Data

Jan. 9, 1989 [DE] Fed. Rep. of Germany ..... 8900172

[51] Int. Cl.[5] ..... B65G 47/34

[52] U.S. Cl. ..... 198/465.4; 242/35.5 A

[58] Field of Search ..... 242/35.5 A; 198/465.4

[56] References Cited

U.S. PATENT DOCUMENTS

| | | | |
|---|---|---|---|
| 4,041,686 | 8/1977 | Inaga et al. | 242/35.5 A X |
| 4,515,328 | 5/1985 | Payne Jr. | 242/35.5 A X |
| 4,739,611 | 4/1988 | Rohner . | |
| 4,854,439 | 8/1989 | Ueda | 242/35.5 A X |
| 4,909,373 | 3/1990 | Geerts | 198/465.4 X |

FOREIGN PATENT DOCUMENTS

| | | | |
|---|---|---|---|
| 2100570 | 3/1978 | Fed. Rep. of Germany | 198/465.4 |
| 0753739 | 8/1980 | U.S.S.R. | 198/465.4 |
| 2043569 | 10/1980 | United Kingdom | 198/465.4 |

*Primary Examiner*—D. Glenn Dayoan

*Attorney, Agent, or Firm*—Finnegan, Henderson, Farabow, Garrett & Dunner

[57] ABSTRACT

Described is a suspension conveyor system for conveying bobbins (1) to predetermined bobbin positions (RSP) in a spinning mill machine, particularly a ring spinning machine, the suspension conveyor system comprising a conveying path passing along the predetermined bobbin positions (RSP) for the travel therealong of at least one driven conveyor train (4) carrying a plurality of bobbins (1). A transfer mechanism (14, 14') mounted for travelling along the spinning mill machine is provided for the transfer of individual bobbins (1) from the conveying path to the predetermined bobbin positions. In order to achieve a rapid and accurate transfer of bobbins (1) to the ring spinning machine the invention proposes to provide a bobbin carriage (14, 14') adapted to travel parallel to the conveying path (3) in unison with the conveyor train (4) and carrying a separating and guide mechanism (16, 30, 32) for the transfer of an individual bobbin (1) from the conveyor train (4) to a predetermined bobbin position (RSP).

25 Claims, 6 Drawing Sheets

SUSPENSION CONVEYOR SYSTEM

BACKGROUND OF THE INVENTION

The invention relates to a suspension conveyor system for conveying bobbins.

A suspension conveyor system of this type is known from U.S. Pat. No. 4,739,611. The known suspension conveyor system comprises a bobbin transfer apparatus mounted for travelling on the floor along a ring spinning machine, and a suspension conveyor path for feeding full bobbins to the apparatus. The bobbin transfer apparatus is moved to a position where an empty bobbin is to be replaced by a full bobbin. A detector mounted on the bobbin transfer apparatus is used to sense whether a full bobbin on the conveyor train is in a suitable position for transfer. If this is the case, a gripper arm is extended to grip the full bobbin, release it from the conveyor train and suspend it at the free position on the ring spinning machine. If a full bobbin is not detected on the conveyor train, the detector acts to activate a drive mechanism of the conveyor train, whereupon the conveyor train is advanced until a full bobbin arrives at the suitable transfer position. This known system requires numerous control operations to be coordinated with regard to their timing sequence and localized function, resulting in a relatively complicated construction and control operation of the known system. The bobbin transfer operation is moreover relatively time-consuming, particularly when the bobbin transfer apparatus has to call first for a full bobbin to be fed. During the transfer operation, moreover, the conveyor train has to be stopped, since the gripper arm is only capable of effective operation when the full bobbin is accurately aligned at a defined position. As a result it is impossible to use for instance two bobbin transfer apparatuses for one and the same machine.

It is therefore an object of the invention to provide an improved suspension conveyor system comprising a bobbin transfer apparatus in a structurally simple manner so as to permit the bobbin transfer operation to be executed rapidly and accurately.

SUMMARY OF THE INVENTION

This object is attained by providing a suspension conveying system for conveying suspended bobbins to predetermined bobbin positions in a spinning mill machine, comprising a conveying path passing along said predetermined bobbin positions, at least one driven conveyor train carrying a plurality of bobbins for conveyance along said conveying path, and a bobbin transfer means for transferring individual bobbins from said conveyor train to said predetermined bobbin positions, said bobbin transfer means comprising a bobbin carriage adapted to travel along parallel to said conveying path and in unison with said conveyor train, said bobbin carriage carrying a separating and guide mechanism for transferring an individual bobbin from said conveyor train to one of said predetermined bobbin positions.

The employ of the bobbin carriage mounted for movement in unison with the conveyor train ensures that a full bobbin is always found at the location where a bobbin transfer is required. The system according to the invention also permits the conveyor train to permanently circulate around the machine in unison with the bobbin carriage. The separation and transfer mechanism according to the invention permits the bobbins to be transferred from the moving conveyor train to the empty bobbin positions, without for instance requiring the conveyor train to be stopped for this purpose.

BRIEF DESCRIPTION OF THE DRAWINGS

Embodiments of the invention will now be described by way of example with reference to the accompanying drawings, wherein.

DETAILED DESCRIPTION OF THE INVENTION

Figure 1:
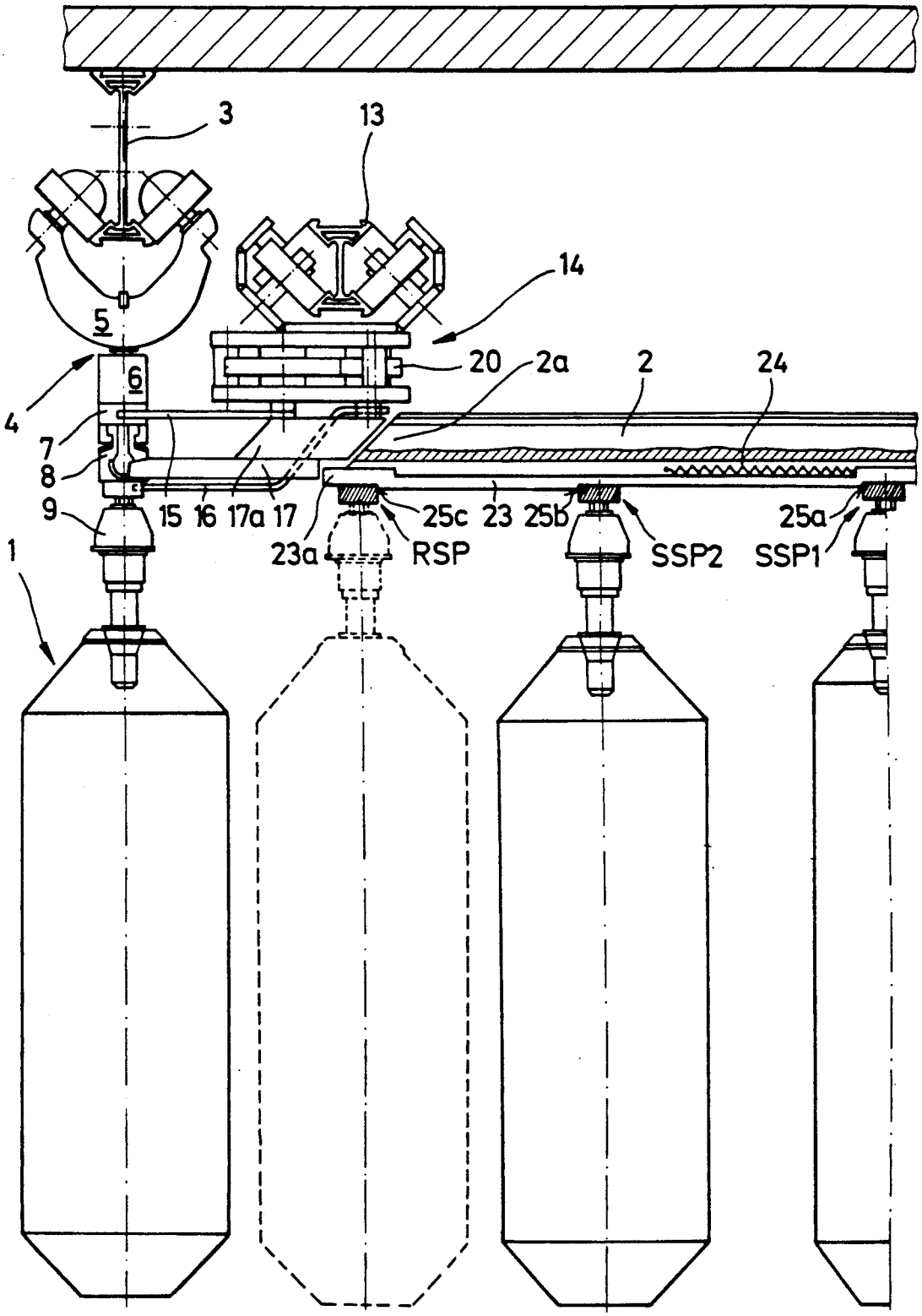
FIG. 1 shows the main components of a suspension conveyor system according to a first embodiment of the invention.

Diagrammatically shown in FIG. 1 are the main components of a suspension conveyor system employed for feeding bobbins 1 to the bobbin suspension grid of a ring spinning machine, a twining machine or the like. The machine itself is not illustrated and may be of any known type. The suspension grid of the spinning machine comprises transverse rails 2 of which only one is shown. In the illustrated embodiment, each transverse rail 2 defines two spin bobbin positions SSP1 and SSP2, and a standby bobbin position RSP. At the side facing away from the (not shown) centerline of the spinning machine each transverse rail 2 has a free end 2*a*. The spinning machine is encircled by a conveying path 3 extending at the same vertical and horizontal spacing from the free ends 2*a* of all transverse rails 2. The conveying path 3 is composed of rails of conventional construction. Supported on conveying path 3 for travelling therealong is at least one conveyor train 4 which is driven by a not shown drive mechanism, for instance a friction belt drive mechanism. In the embodiment shown, conveyor train 4 is composed of runners 5 travelling on the rails of conveying path 3 and connected to one another by a linkage 6. The bobbins to be conveyed are suspended from linkage 6 by respective suspensions. To this purpose a first suspension member in the form of a guide member 7 for each bobbin to be conveyed in conveyor train 4 is secured to linkage 6. Each guide member 7 is adapted to releasably receive a second suspension member in the form of a slide member 8 to which a bobbin holder 9 of conventional construction is secured.

Figure 3:
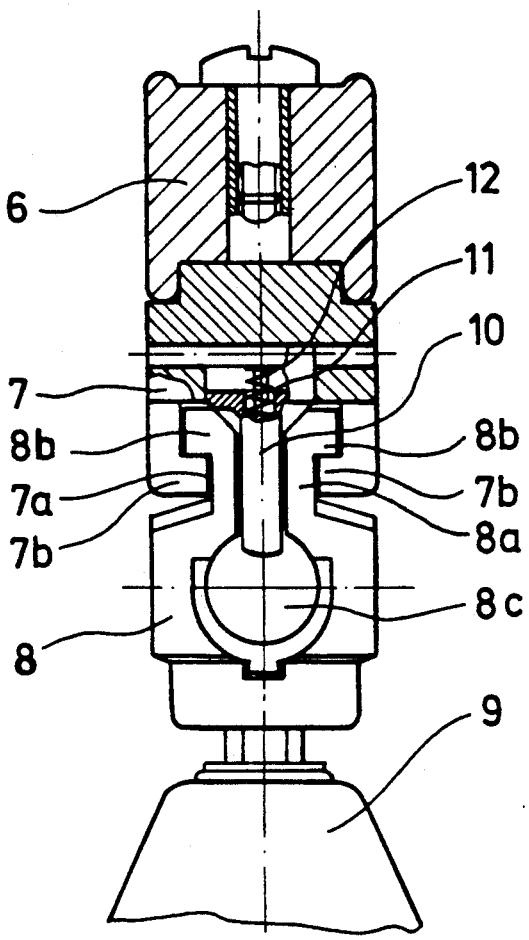
FIG. 3 shows a bobbin suspension on the conveyor train.

As apparent in connection with FIG. 3, a throat portion 8*a* of slide member 8 extends from below into a cavity 7*a* of guide member 7, so that a pair of parallel lateral arm ledges 8*b* are supported on correspondingly shaped ledges 7*b* of guide member 7 for preventing slide member 8 from dropping out of guide member 7. Cavity 7*a*, arm ledges 8*b* and lateral ledges 7*b* all extend parallel to the conveying direction. Slide member 8 is further provided with a substantially circular bore 8*c* extending completely therethrough in the direction of conveying path 3. For locking slide member 8 and guide member 7 together in the conveying direction, guide member 7 is provided with a retaining pin 10 extending into a slot formed in slide member 8 to extend completely therethrough. Retaining pin 10 is formed with a locking cone 11. In its normal position, which it assumes in response to the action thereon of a locking spring 12, cone 11 is received in a conical recess formed in a surface portion of slide member 8 opposite a corresponding surface portion of guide member 7 to thereby interlockingly connect the respective surface portions.

Figure 2:
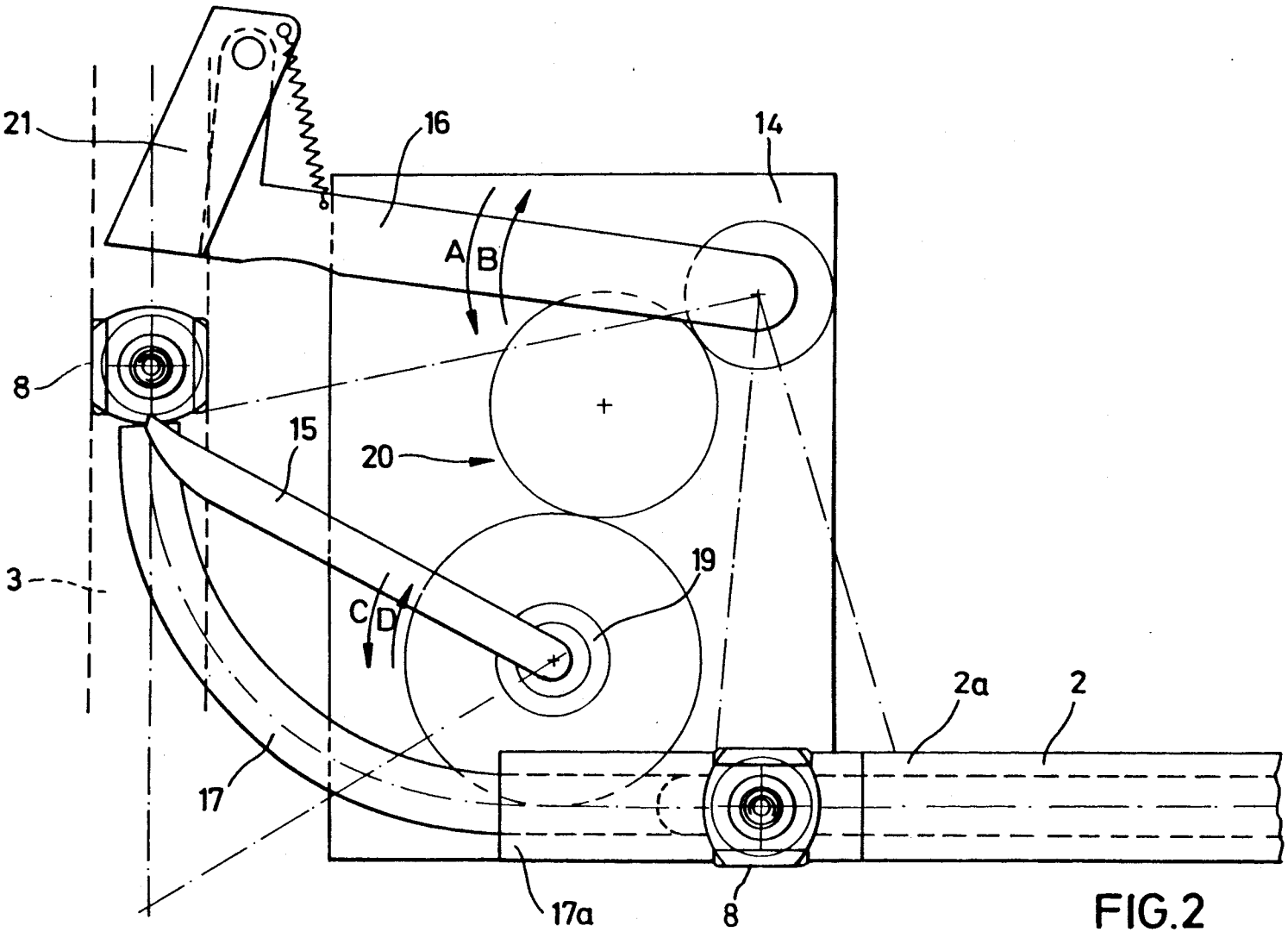
FIG. 2 shows a diagrammatic bottom plan view on an enlarged scale of the bobbin carriage of FIG. 1.

As illustrated in FIG. 1, a further rail track 13 is provided to extend laterally of and parallel to conveying path 3 and to have a bobbin carriage 14 suspended therefrom. Bobbin carriage 14 carries, as also shown in FIG. 2, a trailing mechanism comprising a trailing lever 15, a separating and transfer mechanism comprising a stripper arm 16, and a rail section 17. Bobbin carriage 14 also carries a detent mechanism 18 shown in FIGS. 5 and 6, but omitted in FIG. 1 for the sake of clarity. Trailing lever 15 is B engaged with conveyor train 4, specifically with a guide member 7 thereof. It is rotatably mounted on bobbin carriage 14 and biased by a spiral-wound spring 19 to a position ensuring that bobbin carriage 14 is entrained by the driven conveyor train 4.

A diagrammatically shown gear transmission 20 interconnects the axis of rotation of trailing lever 15 to that of stripper arm 16 in such a manner that the rotation of trailing arm 15 causes stripper arm 16 to be rotated with a transmission ratio of 1.6:1 to 2:1, i.e. up to twice the angle of rotation of the former. Stripper arm 16 is of a downwards offset crank configuration and carries on its free end a pivotally mounted and spring-loaded stripper pawl 21 adapted to engage slide member 8 of bobbin 1 as stripper arm 16 is rotated in the direction of arrow A. When stripper arm 16 is rotated in the opposite direction of arrow B, pawl 21 can be cammed out of the way in the direction of the axis of rotation, so that stripper arm 16 can pass the slide member 8 of a succeeding bobbin.

Figure 4:
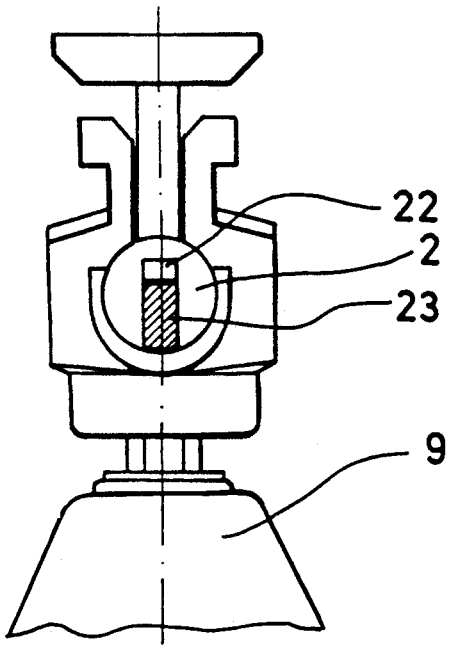
FIG. 4 shows the bobbin suspension in the bobbin position.

Rail section 17 of bobbin carriage 14 has a cross-sectional shape permitting it to enter bore 8*c* of slide member 8; in the example shown, rail section 17 has thus a circular cross-sectional shape and is secured to bobbin carriage 14 by means of a carrier lug 17*a*. Rail section 17 is mounted on bobbin carriage 14 in a manner permitting it to be brought into alignment with the free end 2*a* of each transverse rail 2 in the course of travel of bobbin carriage 14. As shown in FIG. 4, transverse rail 2 has preferably likewise a circular cross-sectional shape with an upwards directed carrier lug. The bottom side of transverse rail 2 is formed with a slot 22 extending rearwards from its free end and having a bar 23 slidably mounted therein. Bar 23 is biased by a tension spring 24 in the direction towards the free end 2*a* of transverse rail 2, so that in the substantially relaxed state of spring 24, an end portion 23*a* of bar 23 acting as a stop member projects from the free end 2*a* of transverse rail 2 and into the path of bobbin carriage 14, specifically into the path of its detent mechanism 18. Each bobbin position SSP1, SSP2 and RSP is defined by a respective abutment 25*a*, 25*b* and 25*c*, respectively, formed on bar 23, the two abutments 25*a* and 25*b* towards the centerline of the spinning machine, whereas abutment 25*c* defining the standby bobbin position faces away from the centerline. Spring 24 is relatively weak, so that it is just able to displace bar 23 alone, but not together with a bobbin.

Figure 6:
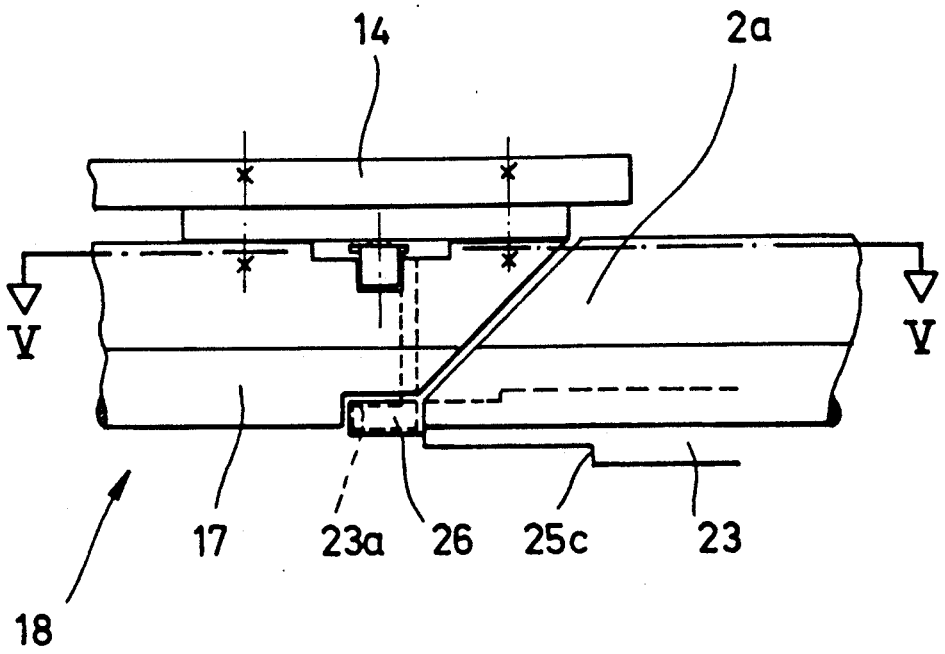
FIG. 6 shows a sideview of the detent mechanism of FIG. 5.
Figure 5:
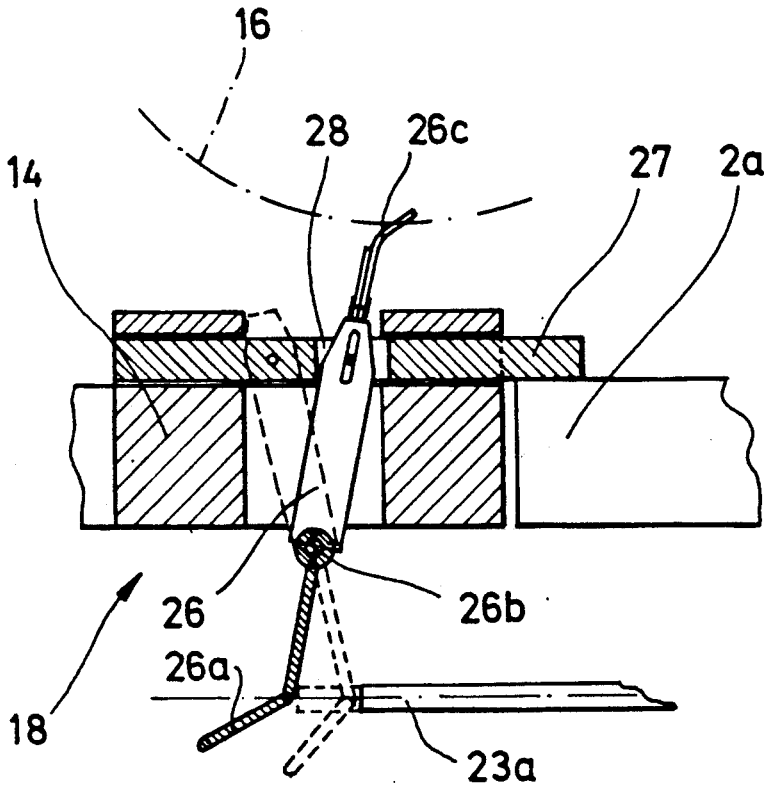
FIG. 5 shows a top plan view of a detent mechanism of the bobbin carriage according to FIG. 1.

As shown in FIGS. 5 and 6, detent mechanism 18 comprises a pivot lever 26 operable to displace a stop bar 27 transversely of the direction of travel of bobbin carriage 14 to a position causing it to abut the free end 2*a* of a transverse rail 2. For better understanding this operation is illustrated in two phases in FIG. 5. The inoperative phase is depicted in dotted lines in this figure. In the operative phase illustrated in solid lines, stop member 23*a* of bar 23 projects into the path of an extension 26*a* of pivot lever 26, whereby the latter is rotated about its axis of rotation 26*b*. As a result, stop bar 27 is displaced to the stop position by the opposite end portion of pivot lever 26 received in an elongate hole 28 of stop bar 27. When stop bar 27 subsequently abuts the free end 2*a* of a transverse rail 2, stop member 23*a* is received in a recess formed in rail section 17 as illustrated in FIG. 6.

The abutment of stop bar 27 on transverse rail 2 causes bobbin carriage 14 to be stopped while conveyor train 4 continues its travel. As a result, bobbin carriage 14 and conveyor train 4 are moved relative to one another. This causes conveyor train 4 to exert a corresponding force on trailing lever 15 and to entrain it against the force of spiral spring 19 in the direction of arrow C to thereby initiate the separating and transfer operation. At the same time rail section 17 enters the bore 8*c* of slide member 8, whereby locking pin 10 with its locking cone 11 is cammed upwards, optionally with the aid of a camming nose (not shown) disposed on rail section 17, so that slide member 8 and guide member 7 are unlocked from one another. Gear transmission 20 transmits the rotary movement of trailing lever 15 to stripper arm 16, causing it to rotate in the direction of arrow A, so that its stripper pawl 21 engages slide member 8 to push it, together with the bobbin 1 suspended therefrom, onto rail section 17 and from there onto the free end 2*a* of transverse rail 2. As slide member 8 is pushed onto the free end 2*a* of rail 2, it comes into contact with abutment 25*c* of bar 23, so that the transfer of slide member 8 to the standby bobbin position RSP causes bar 23 to be displaced in such a manner that its stop member 23*a* is completely retracted into slot 22.

In the meantime trailing lever 15 has been rotated by conveyor train 4 to a position at which it is no longer engaged with conveyor train 4. This permits spiral spring 19 to return trailing lever 15 to the trailing position illustrated in FIG. 2 in the direction of arrow D. In this position trailing lever 15 comes into engagement with the guide member 7 of a succeeding bobbin. Gear transmission 20 transmits this return movement to stripper arm 16, as a result of which the latter is moved in the direction of arrow B to return to its inoperative position shown in FIG. 2. During this return movement in the direction of arrow B, the cranked portion of stripper arm 16 comes into contact with a rear extension 26*c* of pivot lever 26 of detent mechanism 18, as a result of which pivot lever 25 is returned to its starting position indicated by dotted lines in FIG. 5 to thereby retract stop bar 27. This permits bobbin carriage 14 to be again entrained by conveyor train 4 until it reaches the next vacant bobbin position.

As soon as one of the bobbins at spin bobbin positions SSP1 or SSP2 is empty, the empty bobbin is manually or automatically removed. The bobbin suspended at the standby bobbin position is brough to the vacant spin bobbin position, and its slubbing is tied in. To this purpose the bobbin suspended at the standby bobbin position is tilted for releasing its slide member 8 from abutment 25*c*. As a result spring 24 is then capable of advancing bar 23 so that its stop member 23*a* projects from the free end 2*a* of transverse rail 2. This indicates that the standby bobbin position is vacant and should be replenished during the next passage of conveyor train 4 and bobbin carriage 14. When all bobbins have been removed from conveyor train 4, its direction of travel is reversed, so that it can be returned to a loading station or to the flyer without entrining the bobbin carriage.

Figure 7:
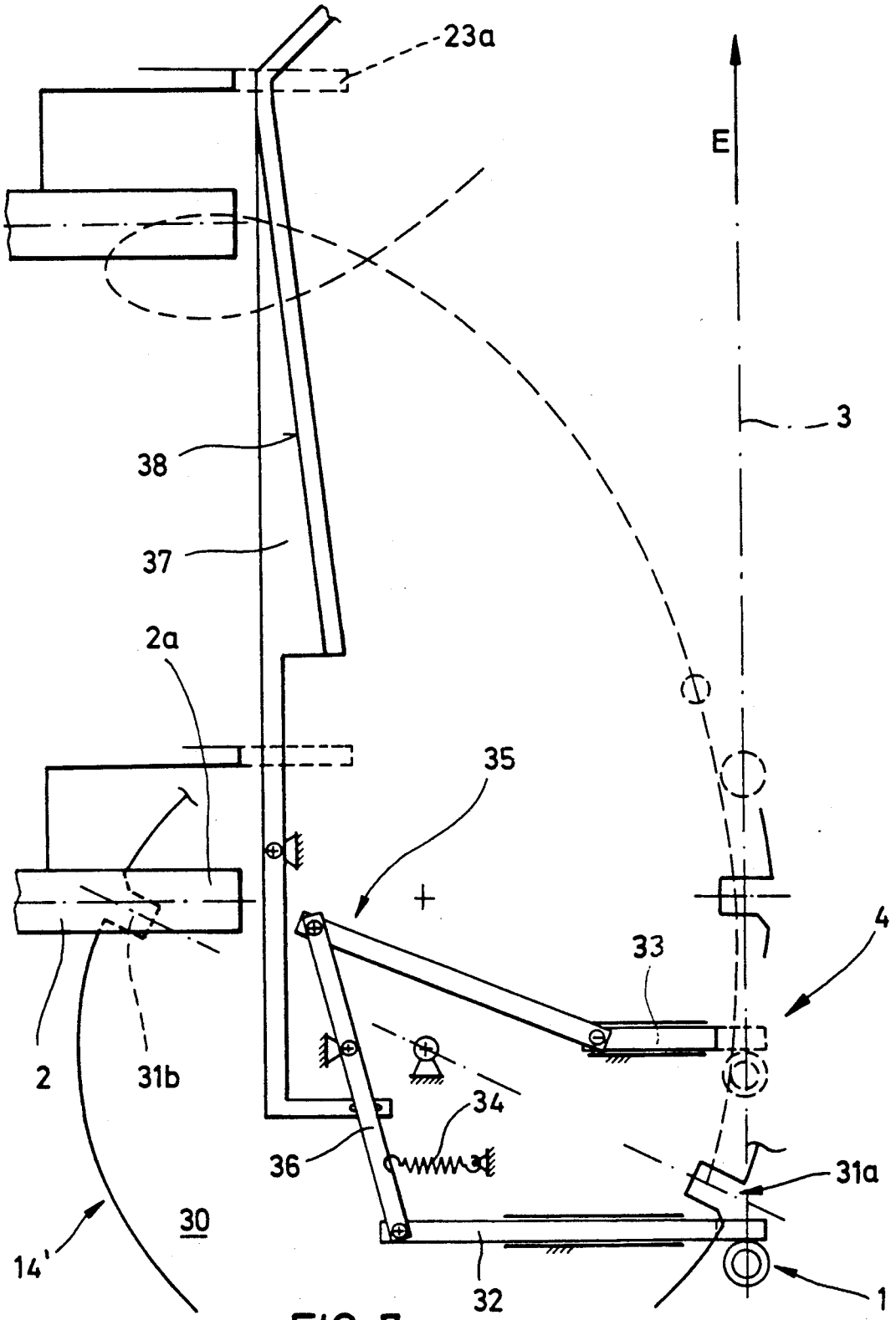
FIG. 7 shows a diagrammatic top plan view of a bobbin carriage according to another embodiment.

Diagrammatically shown in FIG. 7 is another embodiment of the invention in successive phases of operation. The conveying path 3, conveyor train 4, transverse rail 2 and the further rail track 13 for a bobbin carriage correspond to the construction illustrated in FIGS. 1 and 3. Stop member 23*a* may likewise be of the same construction as in the first embodiment, although it may also be disposed above and outwards of transverse rail 2 and manually operable as in the example shown in FIG. 7. The separating and transfer mechanism carried by bobbin carriage 14' is of a different construction, however. This mechanism comprises a turnplate 30 with receptacle notches 31 formed in its periphery. Prferably two such receptacle notches 31*a* and 31*b* are provided at diametrally opposite locations. The receptacle notches 31 are of a configuration permitting them to engage and hold a slide member 8 below its bore 8*c*. A drive mechanism (FIG. 8) is provided for rotating turnplate plate 30. The system again includes a trailing lever 32 and a stripper arm 33 mounted independently of turntable 30 in a sliding guide on bobbin carriage 14' transversely of the direction of travel of conveyor train 4. Similar to trailing lever 15, trailing lever 32 engages conveyor train 4 in such a manner that bobbin carriage 14' is entrained thereby. A spring 34 acts to bias trailing lever 32 towards its trailing position. Stripper arm 33 is in engagement with slide member 8 at the side thereof facing forwards in the direction of travel. Trailing lever 32 and stripper arm 33 are connected to one another by a linkage 35 including a two-armed lever 36 pivotally mounted on bobbin carriage 14'. One arm of double-armed lever 36 is connected to stripper arm 33, and the other arm, to trailing lever 32. The arm of two-armed lever 36 connected to trailing lever 32 is engaged by a spring 34 acting to bias this arm in the direction towards the conveying path 3. This arm is in addition hingedly connected to an actuator lever 37 having a cam surface 38 for engagement with stop member 23*a*.

Figure 8:
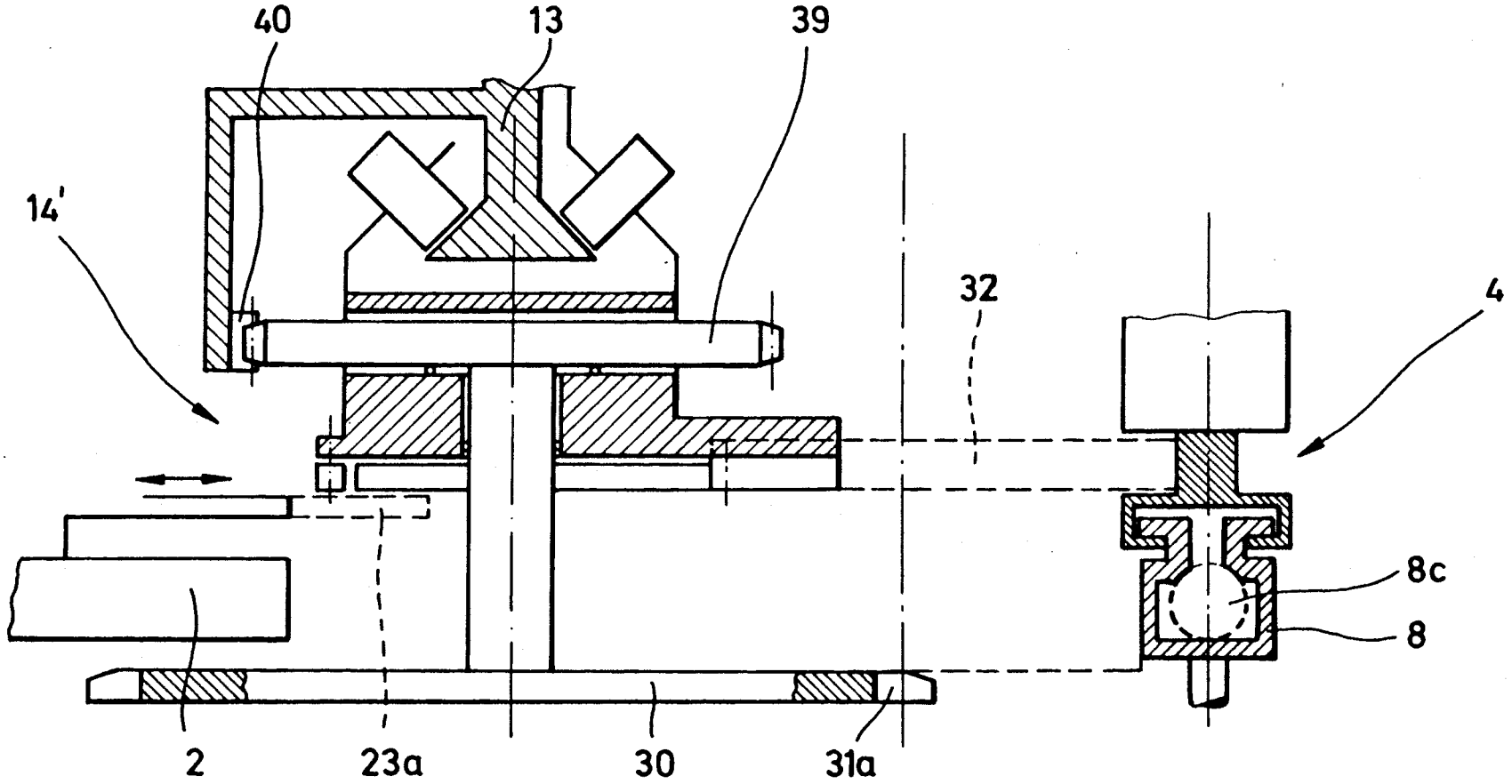
FIG. 8 shows a sideview of the bobbin carriage of FIG. 7.

As shown in FIG. 8, a shaft of turntable 30 carries a pinion gear 39 meshing with a rack 40 disposed at a fixed position relative to bobbin carriage 14' and conveyor train 4. As long as bobbin carriage 14' is entrained by the movement of conveyor train 4, pinion gear 39 travels on rack 40 to thereby rotate turntable 30 relative to conveyor train 4 in an accurately predetermined manner.

When cam surface 38 of actuator lever 37 comes into engagement with a stop member 23*a* projecting from the free end 2*a* of a transverse rail 2, actuator lever 37 is pivoted about its pivot axis and thereby acts to rotate two-armed lever 36 against the action of spring 34. This results in trailing lever 32 being retracted out of engagement with conveyor train 4. At the same time the rotation of two-armed lever 36 causes stripper arm 33 to engage the leading face of the suspension of the bobbin actually disposed in a receptacle notch 31. This results in the respective bobbin being separated from the conveyor train 4, permitting it to be entrained by turntable 30. As a result of the engagement of stripper arm 33 with the suspension of the respective bobbin, bobbin carriage 14' continues to be entrained by the movement of conveyor train 4, so that cam surface 38 is displaced along stop member 23*a*. Due to the increasing distance of cam surface 38 from the free end 2*a* of transverse rail 2, stop member 23*a* eventually reaches a point on cam surface 38 where actuator lever 37 returns to its normal position depicted in FIG. 7. As a result, stripper arm 33 is retracted from its engagement with the suspension of bobbin 1, permitting the latter to be subsequently entrained by the rotation of turntable 30. At the same time trailing lever 32 is again brought into engagement with conveyor train 4, so that bobbin carriage 14' is again entrained by the action of trailing lever 32. After turntable 30 has been rotated by just about 180° as indicated by the dotted line in FIG. 7, the free end 2*a* of transverse rail 2 enters the bore 8*c* of the slide member 8 associated to the bobbin 1 retained in receptacle notch 31. As turntable 30 continues to be rotated to complete its revolution about 180°, the edge of receptacle notch 31*a* acts to push the bobbin further onto transverse rail 2, this action being optionally accompanied by stop member 23*a* being returned to its inoperative position.

In a modification of the embodiments described and illustrated by way of example, the stop member may be adapted to be manually set when an operator has removed the respective bobbin from the standby position. It is also possible to drive the bobbin carriage by means of a drive mechanism in common with the conveyor train, or to derive the entrainment of the bobbin carriage from the travel of the conveyor train in a different manner. As explained with reference to the described embodiments, the suspension conveyor system according to the invention is particularly suitable for conveying sliver bobbins from a flyer to a ring spinning machine. It is also highly useful, however, for other applications of similar nature. The provision moreover of transverse rails is not absolutely necessary, the described suspension conveyor system being also successfully applicable to the replenishment of standby positions in the case of fixed bobbin positions.

We claim:

1. A suspension conveyor system for conveying suspended bobbins to predetermined bobbin positions in a spinning mill machine, comprising a conveying path passing along said predetermined bobbin positions, at least one driven conveyor train carrying a plurality of bobbins for conveyance along said conveying path, and a bobbin transfer means for transferring individual bobbins from said conveyor train to said predetermined bobbin positions, said bobbin transfer means comprising a bobbin carriage adapted to travel along parallel to said conveying path and in unison with said conveyor train, said bobbin carriage carrying a separating and guide mechanism for transferring an individual bobbin from said conveyor train to one of said predetermined bobbin positions.

2. The suspension conveyor system of claim 1, wherein said bobbin carriage is adapted to be entrained by said conveyor train.

3. The suspension conveyor system of claim 2, wherein said bobbin carriage is provided with a trailing device adapted to be moved into and out of engagement with said conveyor train for operatively connecting and disconnecting said bobbin carriage thereto or therefrom, respectively.

4. The suspension conveyor system of claim 3, wherein said trailing device comprises a trailing lever biased by a spring towards a position connecting the bobbin carriage with the conveyor train.

5. The suspension conveyor system of any one of claims 1 to 4, wherein said separating and guide mechanism comprises a stripper device adapted to be moved into and out of engagement with a bobbin for separating said bobbin from said conveyor train and transferring it to a bobbin position.

6. The suspension conveyor system of claim 1, including a stop member projecting into the path of said bobbin carriage for indicating a vacant predetermined bobbin position.

7. The suspension conveyor system of claim 6, wherein said stop member is adapted to actuate a detent mechanism on said bobbin carriage for retaining said bobbin carriage relative to the travelling conveyor train.

8. The suspension conveyor system of claim 1, wherein said bobbin carriage carries a rail section for supporting a suspension member from which said bobbin is suspended.

9. The suspension conveyor system of claim 5, wherein said stripper device is operatively connected to said trailing device by a transmission means and is pivotally moved by movement of said trailing device.

10. The suspension conveyor system of claim 5, wherein said stripper device is operatively connected to said trailing device by a linkage.

11. The suspension conveyor system of claim 10, including a stop member projecting into the path of said bobbin carriage for indicating a vacant predetermined bobbin position.

12. The suspension conveyor system of claim 11, wherein said linkage cooperates with said stop member to be thereby moved to a position causing said trailing device to be disengaged from said conveyor train, and said stripper device to be engaged with said bobbin to be transferred.

13. The suspension conveyor system of claim 10, wherein said separating and guide mechanism comprises a turntable provided with at least one receptacle for a bobbin and adapted to be rotated in response to the travel of said conveyor train.

14. The suspension conveyor system of claim 13, wherein said turntable is connected to a pinion gear meshing with a rack.

15. The suspension conveyor system of claim 13, wherein said receptacle comprises a notch formed in the periphery of said turntable and adapted to receive therein the bobbin to be transferred as said turntable is rotated.

16. The suspension conveyor system of claim 1, including a plurality of said bobbin positions located on a rail feeding the spinning machine that extends transverse to the conveying path.

17. The suspension conveyor system of claim 6, wherein said stop member is disposed on a slidable bar provided at said predetermined bobbin position, said bar being formed with an abutment for said bobbin for retracting said stop member from the path of said bobbin carriage in response to said bobbin being transferred to said predetermined bobbin position.

18. The suspension conveyor system of claim 17, wherein said bar is biased by a spring in a direction towards the path of said bobbin carriage.

19. The suspension conveyor system of claim 1, wherein the transfer movement of said separating and guide mechanism is derived from a movement of said bobbin carriage or said conveyor train.

20. The suspension conveyor system of claim 1, wherein the conveyor train comprises a runner adapted to run along a rail with the bobbin suspended therefrom, a first suspension member connected to said runner, a second suspension member connected to said bobbin and releasable connection means formed between said first and second suspension members.

21. The suspension conveyor system of claim 20, wherein said connection means comprises at least one support surface formed on each of said suspension members, the support surface of said second suspension member being carried on the support surface of said first suspension member.

22. The suspension conveyor system of claim 20 including between said first and second suspension members a locking device comprising a projection disposed on one of said suspension members and adapted to engage a recess formed on the other of said suspension members and to be displaced against the bias of a spring.

23. The suspension conveyor system of claim 22, including a locking pin fixedly connected to said projection for automatically releasing said locking device.

24. The suspension conveyor system of claim 20, wherein said second suspension member includes at least one bearing surface for engagement with a rail section on said bobbin carriage.

25. The suspension conveyor system of claim 24, wherein said second suspension member comprises two parallel arms extending upwards into a cavity of said first suspension member and formed with a support surface ledge supported on a corresponding support surface ledge of said first suspension member, and said second suspension member has a passage extending therethrough, the shape of which conforms to the shape of the rail section.

* * * * *